US006561696B1

(12) United States Patent
Rusnak et al.

(10) Patent No.: US 6,561,696 B1
(45) Date of Patent: May 13, 2003

(54) DRAW TAPE BAG AND METHOD OF MANUFACTURE

(75) Inventors: John E. Rusnak, Aurora, IL (US); Robert W. Fraser, Lombard, IL (US); Jack F. Melvan, Oak Forest, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 08/834,225

(22) Filed: Apr. 15, 1997

(51) Int. Cl.[7] ..... B65D 33/28
(52) U.S. Cl. ..... 383/75; 493/225
(58) Field of Search ..... 383/75; 493/225

(56) References Cited

U.S. PATENT DOCUMENTS 2,799,611 A * 7/1957 Dreisbach ..... 156/70
3,653,583 A * 4/1972 Meyer ..... 383/26
4,588,463 A * 5/1986 Barber et al. ..... 156/200
4,813,792 A * 3/1989 Belmont et al. ..... 383/75
4,842,421 A * 6/1989 Bullard et al. ..... 383/61.4
4,878,764 A * 11/1989 Meyer ..... 383/72
5,133,607 A * 7/1992 Bonke ..... 383/75
5,374,232 A * 12/1994 Cipollone ..... 493/194
5,716,137 A * 2/1998 Meyer ..... 383/75

* cited by examiner

*Primary Examiner*—Stephen P. Garbe
(74) *Attorney, Agent, or Firm*—Thomas C. Feix

(57) ABSTRACT

A plastic draw tape bag includes a non-destructive hem seal which runs along the width of the bag to secure the draw tape. The seal is created by bonding two layers of film by using an adhesive, a hot seal, or a coextruded film. When stressed by adequate forces, the seal will partially open without tearing the film. However, it will open only to the extent that the load exceeds the seal strength. Once the film absorbs the load and the stress is relieved, the seal will stop opening and the remaining portion of the seal will remain intact. Thus, the stress concentration is dissipated without tearing the film at or near the seal. As a result, the bag will fail only when the forces on the bag exceed the load bearing limit of the film.

75 Claims, 11 Drawing Sheets

FIG. 7
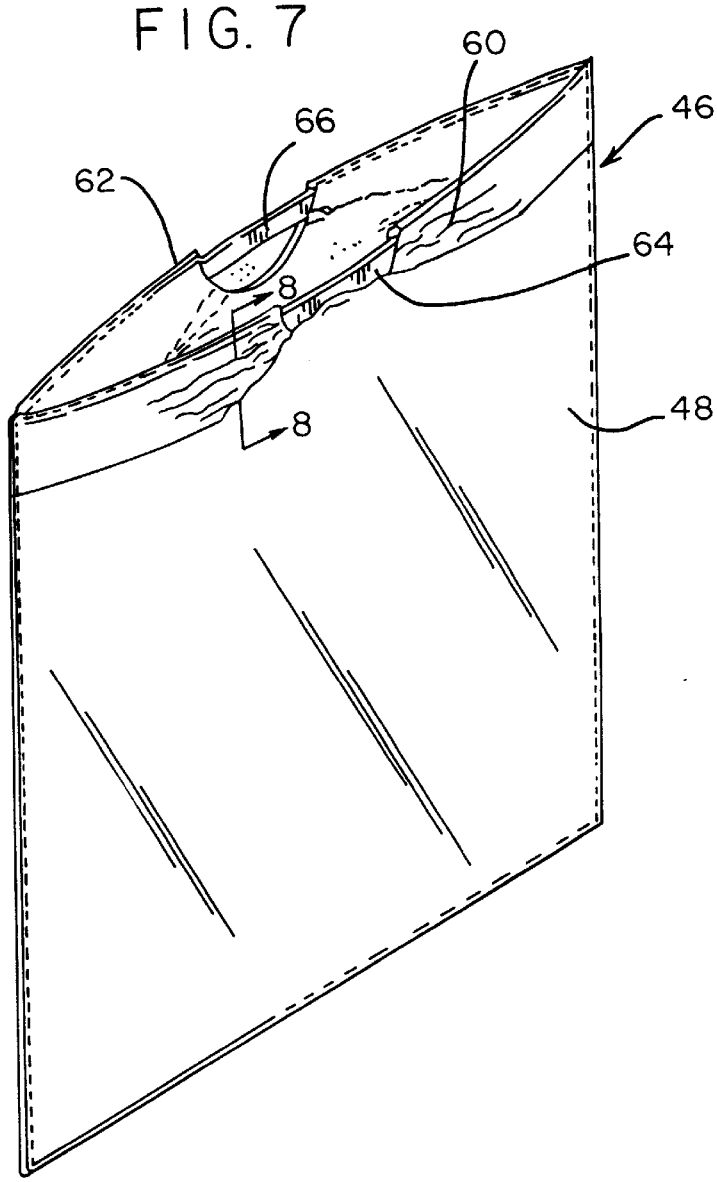
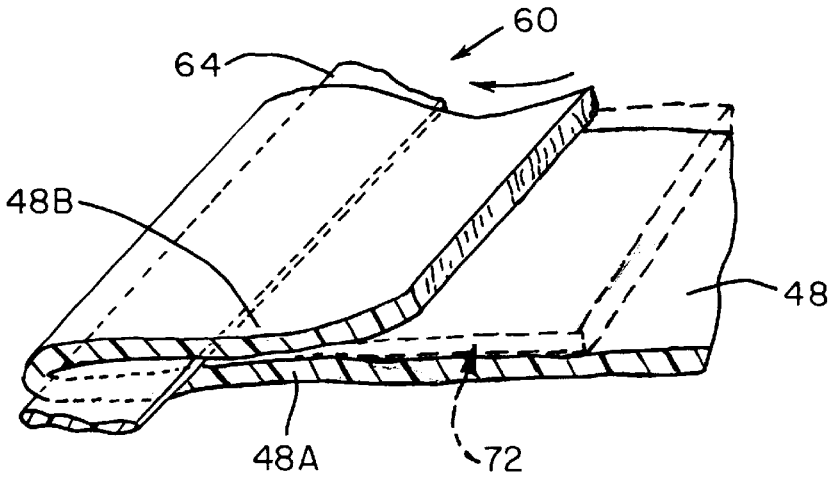
FIG. 8

DRAW TAPE BAG AND METHOD OF MANUFACTURE

FIELD OF THE INVENTION

The invention relates to plastic draw tape bags and more particularly, to a non-destructive hem seal for such bags.

BACKGROUND OF THE INVENTION

A draw tape bag includes of two layers of plastic film which are sealed on three sides and open on the remaining side to form an opening in the bag. A hem securing the draw tape is provided at the periphery of the open end whereby the tape is accessed through openings in the hem. By pulling the draw tape, the opening in the bag closes. Consequently, the draw tape serves as a handle whereby the bag may be grasped to be subsequently transported. The hem in a draw tape bag is formed by two layers of film which are fused together to create a hem seal. The hem seal is typically created by heating the film until it melts and then fusing the two layers together. Heat sealing operations typically create a strong bond which cannot be separated without destroying the film, otherwise known as a destructive bond. Draw tape bags and methods for making draw tape bags are shown in U.S. Pat. Nos. 4,867,735, 4,966,059, and 5,006,380 which are incorporated herein by reference.

Under certain circumstances, a draw tape bag with a destructive hem seal may fail if it is filled with waste and lifted by the hem in contrast to being lifted by the draw tape. The draw tape distributes forces more equally around the perimeter of the hem seal. For example, a person trying to remove a draw tape bag from a garbage container will often grab the bag at or near the hem before using the draw tape to close the bag. As a result, the stresses from the weight of the bag and any additional forces needed to remove the bag from the container are concentrated at the portion of the hem seal where the bag is being grasped. Because heat sealing operations may thin or weaken the film at the point of fusion, the film may tear at the seal when the bag is removed from the garbage container. Under such circumstances, the failure of the bag may cause the contents of the bag to escape.

Therefore, a need exists for a bag with a non-destructive seal, or a seal which opens when stressed. Such a bag would allow the hem seal to partially open and relieve the stress at the seal. Thus, such a bag would not tear prematurely at the hem seal and the bag would only fail when the forces on the bag exceed the load bearing limit of the film. More specifically, the hem seal may experience a load during use which may create stress concentrations along segments of the hem seal. The non-destructive hem seal will partially open to relieve the stress at these segments of the hem seal. The non-destructive hem seal will open only to the extent that the load exceeds the bond strength of the seal. Once the film of the bag absorbs the load and the stress concentration is relieved, the hem seal will stop opening and the remaining portion of the seal will remain intact to adequately secure the draw tape. The localized stress relief effect relieves the stress at the stressed segment of the hem seal while the film layers continue to absorb and distribute the load. Thus, the stress concentration is dissipated without tearing the film at or near the hem seal.

OBJECTS OF THE INVENTION

A general object of the present invention is to provide a reliable draw tape bag which will not tear at the hem seal before the load bearing properties of the film fails. Another object of the invention is to create a hem seal which will partially open, thus relieving the stress concentrations around the seal, when requisite forces are present. Another object of the invention is to create a non-destructive hem seal in which the film is bonded by an adhesive, heat sealing, or co-extrusion means. A further object of the present invention is to create a bond such that the force required to open the seal is less than the force required to thin the film to the point of tearing. Another object of the invention is to create a bond strong enough to secure the draw tape in the hem under normal use conditions.

A further object of the present invention is to provide a hem seal which provides opportunities for reducing manufacturing costs and improves process variability. Other objects and advantages of the invention will become apparent upon reading the following description and upon reference to the drawings.

SUMMARY OF THE INVENTION

A draw tape bag includes two layers of plastic film in which three sides of each layer are sealed. The remaining side forms an opening in the bag for the reception of items, such as, waste. The hems are provided at the periphery of the open end and are created by folding each layer of film over its corresponding surface. The hems enclose a draw tape whereby the tape is accessed through openings in the hem. The hem is formed by two layers of the film to form a channel adjacent a hem seal, whereby the channel secures the draw tape within the hem. The hem seal is bonded by using an adhesive, a hot seal, or a heat sealed coextruded film such that a non-destructive seal is formed.

The non-destructive seal will open without destroying the two layers of film bonded by the hem seal. When adequate forces are present, the hem will peel from the seal to relieve the stress at the seal. As a result, the bag will not tear prematurely at the hem seal and the bag will fail when the forces on the bag exceed the load bearing limit of the film.

BRIEF DESCRIPTION OF THE DRAWINGS

For a more complete understanding of this invention reference should now be had to the embodiments illustrated in greater detail in the accompanying drawings and described below by ways of examples of the invention. In the drawings:

FIG. 7 is a perspective view of a draw tape bag of this invention after a portion of the hem seal has opened;

FIG. 8 is a cross-sectional view taken along line 8—8 of FIG. 7;

DETAILED DESCRIPTION OF THE DRAWINGS

Figure 1A:
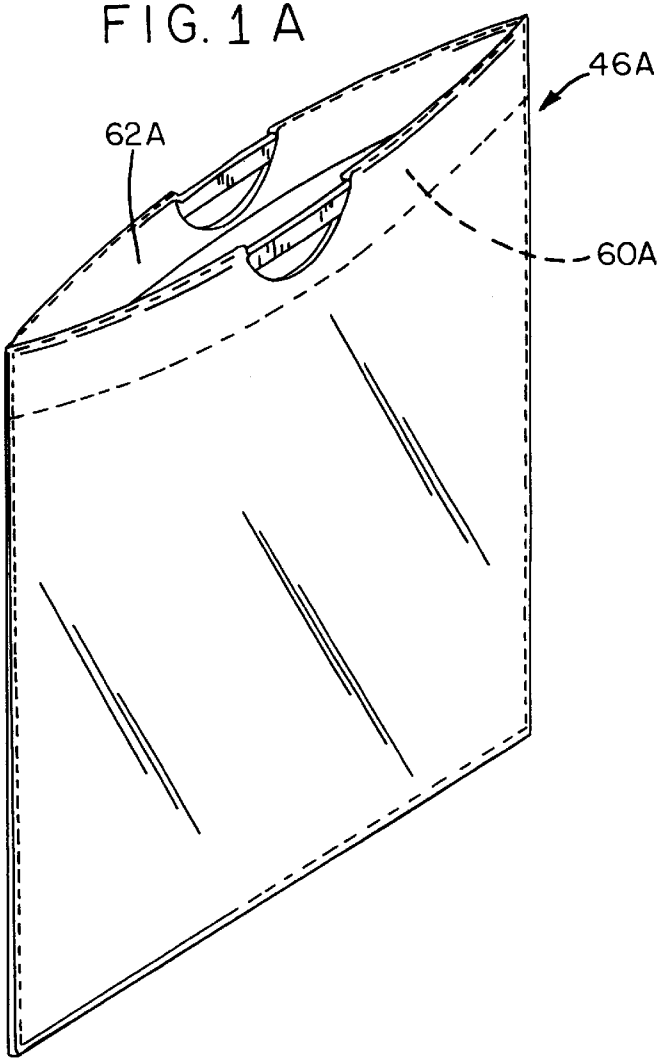
FIG. 1A is a perspective view of another embodiment of a draw tape bag.
Figure 1:
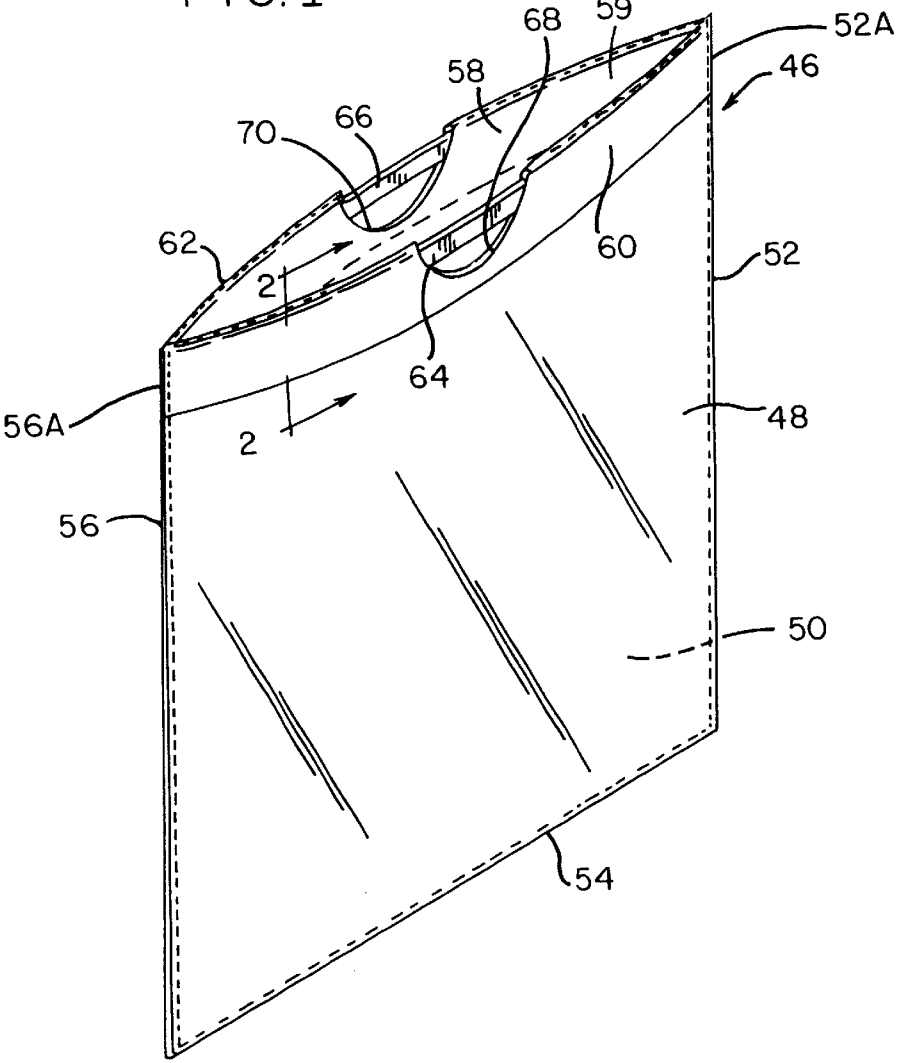
FIG. 1 is a perspective view of a draw tape bag.

Referring to FIG. 1, a draw tape bag 46 consists of two layers 48, 50 of plastic film in which three sides of each layer 52, 54 and 56 are sealed. The remaining side 58 forms an opening 59 in the bag for the reception of waste and the like. The hems 60, 62 are provided at the periphery of the opening 59 and are created by folding each layer of film 48 and 50 over its corresponding outside surface. The hems 60 and 62 enclose draw tapes 64, 66 whereby the tapes are accessed through openings 68, 70 in the hems. The draw tapes 64, 66 are attached at the two sides 52A and 56A. By pulling the draw tapes 64, 66, the opening 59 in the bag closes. As a result, the draw tapes 64, 66 may serve as a handle to transport the bag 46. FIG. 1 shows a draw tape bag 46 with the hems located on the outside of the bag. FIG. 1A shows another embodiment of a draw tape bag 46A with the hems 60A, 62A located on the inside of the bag.

Figure 2:
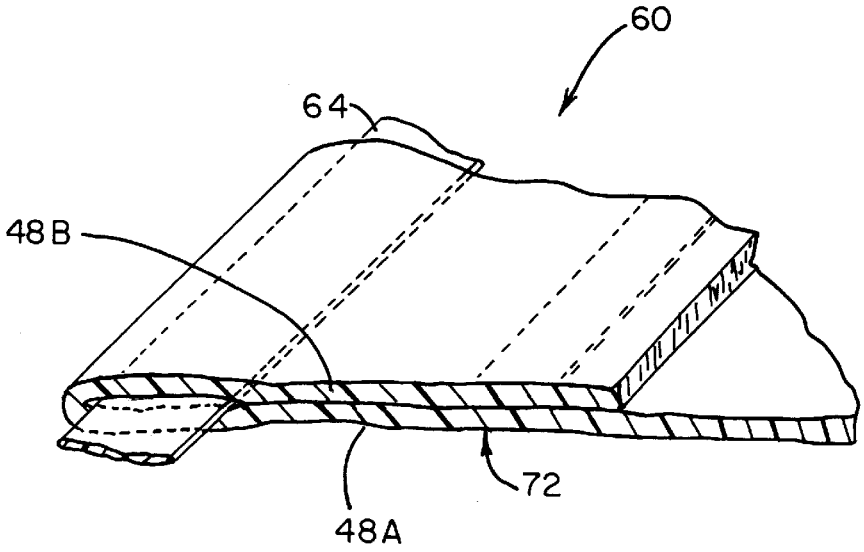
FIG. 2 is a partial cross-sectional view taken along the line 2—2 of FIG. 1.

As shown in FIG. 2, the hem 60 includes a hem flap 48B, a hem portion 48A and a hem seal 72. The hem flap 48B is folded over the hem portion 48A and bonded by the hem seal 72. The hem seal 72 runs along the width of the bag below the draw tape 64. The hem seal 72 secures the draw tape 64 within the hem 60. The hem seal is bonded by using an adhesive, a hot seal, or a heat sealed coextruded film, such that, a non-destructive seal is formed. A non-destructive seal will open when stressed without destroying the hem portion 48A and the hem flap 48B bonded by the hem seal 72. More specifically, the hem seal may experience a load during use which may create stress concentrations along segments of the hem seal. The non-destructive hem seal will partially open to relieve the stress at these segments of the hem seal. The non-destructive hem seal will open only to the extent that the load exceeds the bond strength of the seal. Once the film of the bag absorbs the load and the stress concentration is relieved, the hem seal will stop opening and the remaining portion of the seal will remain intact to adequately secure the draw tape. The localized stress relief effect relieves the stress at the stressed segment of the hem seal while the film layers continue to absorb and distribute the load. Thus, the stress concentration is dissipated without tearing the film at or near the hem seal.

In order to fully appreciate this invention of a non-destructive hem seal, it is necessary to review prior hem seal constructions. Typically, hem seals are formed through heat sealing operations which result in a bond between two film layers that cannot be separated without tearing the film, i.e., a destructive bond. Such seals are formed by melting the layers of film and fusing them together.

Under certain circumstances, a draw tape bag with a destructive hem seal may fail if it is filled with waste and lifted by grasping the opening of the bag at the hem, as contrasted with being lifted by the draw tape which distributes forces more equally around the perimeter of the hem seal. For example, a person trying to remove a draw tape bag from a garbage container will often grab the bag at or near the hem before using the draw tape to close the bag. As a result, the stresses from the weight of the bag and other forces needed to remove the bag from a refuse container are concentrated at the portion of the hem seal where the bag is being grasped. The additional forces required to remove the bag from a refuse container may include any force needed to overcome a vacuum created between the bag and the container when the bag is removed and/or a force to overcome frictional forces between the bag and the refuse container when the bag is removed. Because some heat sealing operations both thin the film at the point of fusion and upon cooling cause crystallization and other weakening phenomena, the film may tear at the seal where the film is thinner and weaker when either the bag's contents are sufficiently heavy and/or when significant force is necessary to remove the bag from the garbage container.

Figure 3:
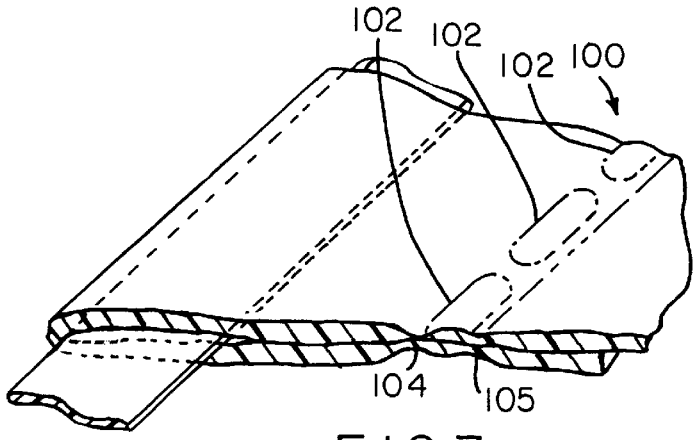
FIG. 3 (PRIOR ART)
FIG. 3 is a partial cross-sectional view depicting a prior art seal utilizing heat and pressure seal bars to secure the hem.
Figure 4:
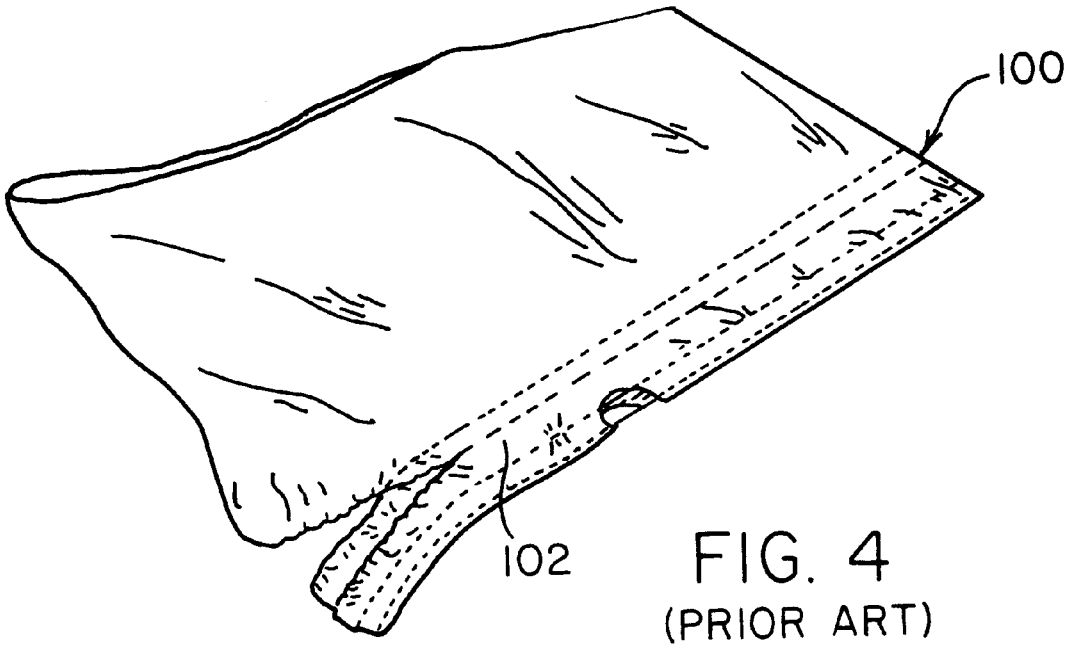
FIG. 4 (PRIOR ART)
FIG. 4 is a perspective view depicting the tearing in a prior art bag which utilized heat and pressure seal bars to secure the hem.

An example of prior art seals are shown in U.S. Pat. No. 4,558,463 and in FIGS. 3–6. Specifically, FIG. 3 illustrates a prior art intermittent heat seal 100 formed by applying heat and pressure at interrupted locations 102. ('463 patent, col. 3, lines 21–23). Polyethylene shrinks upon the application of heat. ('463 patent, col. 3, lines 23–24). As a result of application of heat and pressure, the polyethylene shrinks back from the sealing bar forming two thinned portions 104, 105. ('463 patent, col. 3, lines 23–27). The polyethylene at the sides of these thinned portions has been reoriented because of the shrinkage. ('463 patent, col. 3, lines 27–29). This reorientation strengthens the plastic at the shoulders of the thinned portion. ('463 patent, col. 3, lines 29–30). This results in a concentration of stress in the thinned portion. ('463 patent, col. 3, lines 30–32). This stress concentration propagates a tear once it is started as is depicted in FIG. 4. ('463 patent, col. 3, lines 32–33). The tear propagates in spite of the interruptions in the thinned portions caused by the intermittent sealing bar. ('463 patent, col. 3, lines 33–35). Because the stress is concentrated in the thinned portions, the tear jumps from one thinned portion to another. ('463 patent, col. 3, lines 35–37). The intermittent seal 100 is an example of a destructive bond which when stressed will tear.

Figure 5:
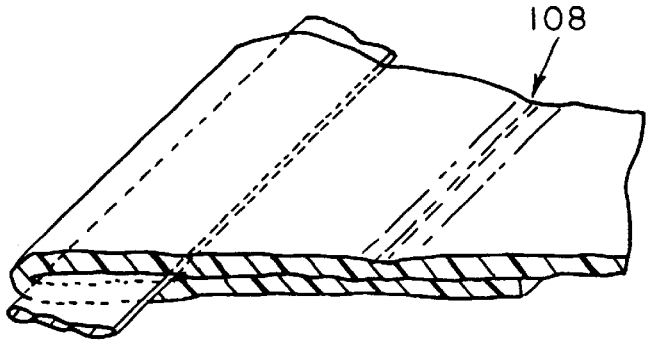
FIG. 5 (PRIOR ART)
FIG. 5 is a partial cross-sectional view depicting a prior art seal utilizing a tack seal to secure the hem.
Figure 6:
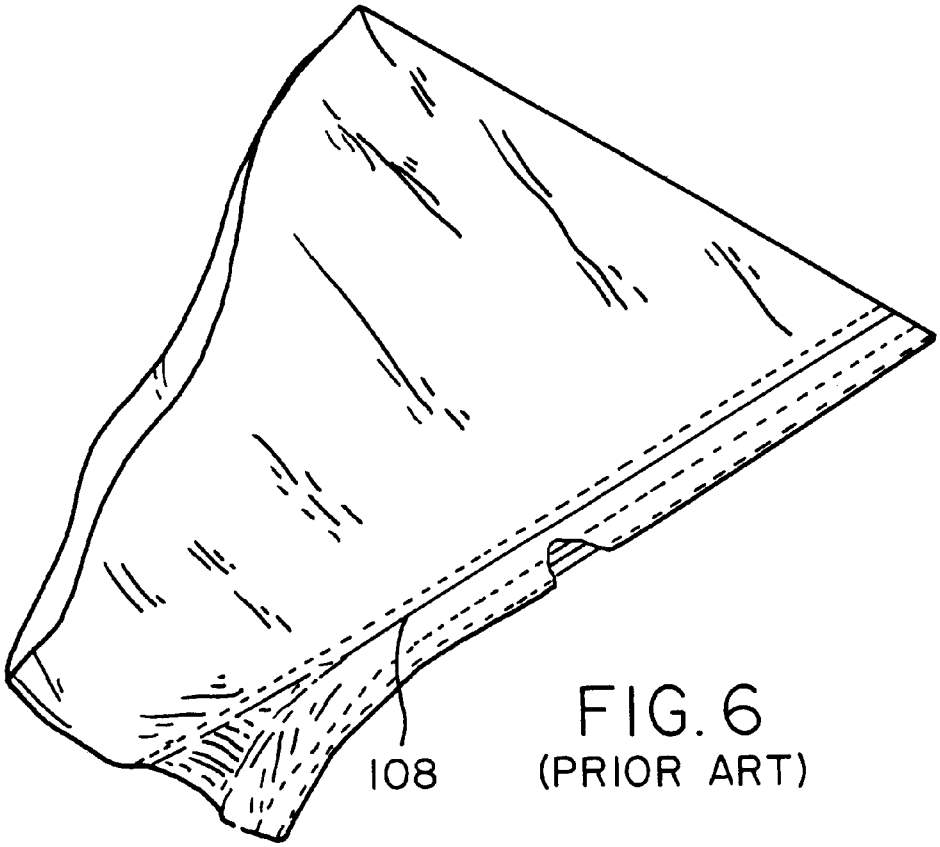
FIG. 6 (PRIOR ART)
FIG. 6 is a perspective view depicting tearing in a prior art bag which utilized a tack seal to secure the hem.

FIG. 5 represents a prior art tack seal 108 from U.S. Pat. No. 4,558,463. The tack seal 108 includes a continuous line of heat fused polyethylene between the hem portion and the adjacent panel. ('463 patent, col. 3, lines 49–51). The heat seal includes a single groove formed solely by application of moderate heat. ('463 patent, col. 3, lines 51–52). Only sufficient heat has been applied to melt the adjacent surfaces of the hem portion and the adjacent panel. ('463 patent, col. 3, lines 52–54). When a tear is initiated at the edge of the bag, as indicated in FIG. 6, the tear propagates as a stretching of the polyethylene. ('463 patent, col. 4, lines 57–59). Rather than being propagated in a single narrow groove, the tear is distributed to areas on both sides of the groove. ('463 patent, col. 4, lines 59–61). The tack seal in the '463 patent is an improvement over the prior art seal (in FIGS. 3 and 4 of the '463 patent), however, it is still a destructive bond that will not open up to relieve the stress at the hem seal.

In contrast to the prior art, this invention involves a non-destructive seal. Referring to FIGS. 7 and 8, the-non-destructive seal 72 allows the hem seal 72 to partially open and relieve the stress concentration at the stressed location of the hem seal without tearing the film layers and without opening the hem seal along the entire length of the hem seal. The non-destructive seal 72 opens under the condition(s) wherein prior art fused hem seals would result in a tearing of the film layers. A non-destructive hem seal 72 will open only to the extent that the load exceeds the bond strength of the hem seal 72. Once the layer of film 48 absorbs the load and the stress concentration is relieved, the hem seal 72 will stop opening and the remaining portion of the hem seal 72 will remain intact to adequately secure the draw tape 64, 66. The localized stress relief effect relieves the stress at the stressed segment of the hem seal 72 while the film layer 48 continues to absorb and distribute the load. Thus, the stress concentration is dissipated without tearing the film at or near the hem seal. For purposes of this discussion, the non-destructive hem seal is sometimes referred to as a "peelable" seal.

As a result, the bag will not tear unless the load exceeds the load bearing limit of the film layer 48. The force required to open the hem seal 72 is less than the force required to thin the film layer 48 to the point of tearing. Nevertheless, the hem seal 72 must be strong enough to secure the draw tape 64 under normal use conditions. The non-destructive hem seal can be characterized by the peel energy which is a measure of the energy required to open the hem seal (i.e. peel the sealed hem portion and hem flap apart) and can be graphically depicted as the area under the load vs. elongation curve. The minimum peel energy for a hem seal to function in draw tape bag is about 0.02 in-lbs. as measured in accordance with test method noted below. The maximum peel energy for a non-destructive hem seal would be a value less than the energy required to break the film.

The peel energy may have the following ranges:

| Range | Minimum Peel Energy | Maximum Peel Energy |
|---|---|---|
| 1 | 0.02 in-lbs. | 99.9% of energy to break film |
| 2 | 10% of energy to break film | 90% of energy to break film |
| 3 | 20% of energy to break film | 70% of energy to break film |
| 4 | 20% of energy to break film | 50% of energy to break film |

Figure 9D:
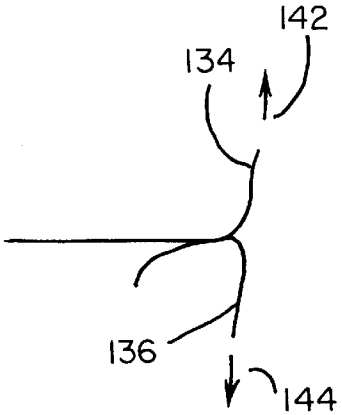
FIG. 9D is a cross-sectional view of the hem seal in FIG. 9C which is being pulled for the test procedure.
Figure 9C:
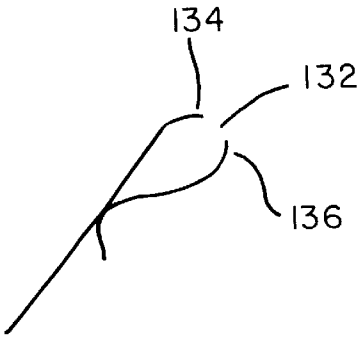
FIG. 9C is a cross-sectional view of the hem seal in FIG. 9B which has been cut for the test procedure.
Figure 9B:
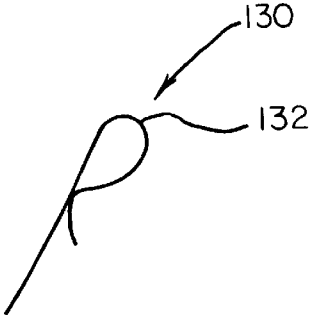
FIG. 9B is a cross-sectional view of the hem seal taken at area 9B in FIG. 9A.
Figure 9A:
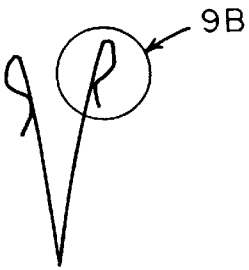
FIG. 9A is a schematic cross-sectional view of a draw tape bag to describe the test procedure.

The peel energy was measured using the Standard Test Method for Tensile Properties of Thin Plastic Sheeting (ASTM D 882–91) with one inch wide samples. FIGS. 9*a*–9*d* show the manner in which the seals were prepared for the test. FIG. 9A shows a cross-sectional view of a draw tape bag. FIG. 9B shows an enlarged view of the hem seal taken at area 9B in FIG. 9A. The draw tape bag was cut into one inch wide strips to obtain the hem seal sample 130 shown in FIG. 9B. Thus, the length of the hem seal was one inch. Referring to FIG. 9C, the hem seal sample 130 was cut at location 132 to create film segments 134, 136. The film segments 134, 136 were pulled apart in directions 142, 144 to peel the seal apart as shown in FIG. 9D and in accordance with Standard Test Method ASTM D882-91.

Figure 10A:
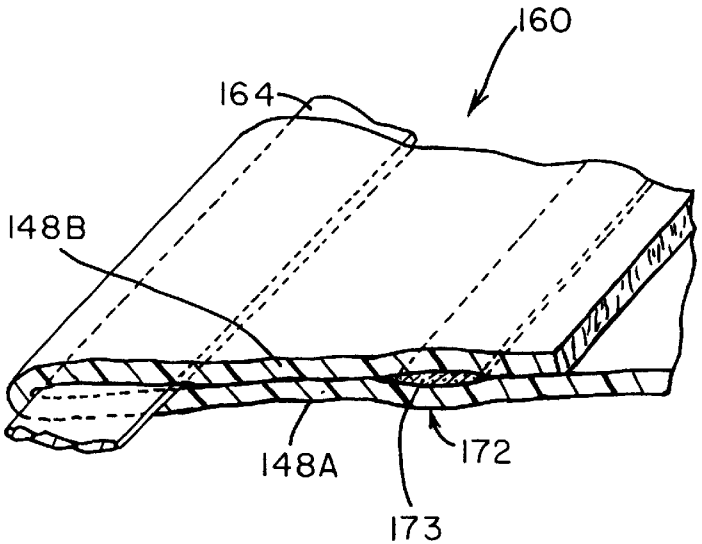
FIG. 10A is a partial cross-sectional view taken along line 2—2 of FIG. 1 of one embodiment.

In one embodiment, the non-destructive seal may be achieved by using an adhesive which bonds the two layers of film. Specifically, referring to FIG. 10A, a hem seal 172 of hem 160 is achieved by using an adhesive 173 which bonds the hem portion 148A to the hem flap 148B. The hem portion 148A and the hem flap 148B enclose the draw tape 164. The adhesive may be a hot melt adhesive. The hot melt adhesive is not tacky until the adhesive is heated and bonds the two film layers when the adhesive cools. The hot melt adhesive may be an adhesive by Findley Adhesives, Inc. of 11320 Watertown Plank Road, Wauwatosa, Wis., U.S.A. under Product No. H1354-01. Product No. H1354-01 has a density of 0.97 g/cc, a softening point of 158° F. (Herzog Automatic Ring and Ball), a suggested running temperature of 325° F. and a thermosel viscosity of: 4,200 cP @300° F./27/50 rpm; 2,850 cP @325° F./27/50 rpm; 2,000 cP @350° F./27/50 rpm.

The adhesive may also be a pressure sensitive adhesive. The pressure sensitive adhesive is tacky when the adhesive is either hot or cold, and bonds the two layers when pressure is applied to the layers and the adhesive. The pressure sensitive adhesive may be a hot melt pressure sensitive adhesive by Findley Adhesives, Inc. of 11320 Watertown Plank Road, Wauwatosa, Wis., U.S.A. under Product No. H 2284-01. Product No. H 2284-01 has a density of 0.94 g/cc, a softening point of 206° F. (Herzog Automatic Ring and Ball), a suggested running temperature of 290–340° F., a thermosel viscosity of: 11,000 cP at 300° F./27/20; 6,900 cP at 325° F./27/20 rpm; 5,400 cP at 350° F./27/50, a Polyken Probe Tack of 1700 g/cm2, a SAFT of 160° F., and a 180° Peel of 6.5 pli.

The hem portion 148A and the hem flap 148B may be made of linear low density polyethylene which is approximately 1 mil (0.001 inch) thick. The layers, including the hem portion and hem flap, may be made from a resin supplied by Union Carbide Chemicals and Plastics Co., Polyolefins Division, 39 Old Ridgebury Road, Danbury, Conn., U.S.A. under Product No. STE-1136 with the following features: 0.925 g/cc density (ASTM D-1505); 0.50 g/10 min. melt index (ASTM D-1238); and hexene copolymer.

Under circumstances where the seal is stressed beyond a predetermined level, the adhesive 173, the hem portion 148A and the hem flap 148B will peel away from one another. For example, the hem seal could experience a cohesive failure wherein the adhesive 173 separates and a portion of the adhesive is on the hem portion and the remaining portion is on the hem flap. As another example, the hem seal could experience an adhesive failure wherein the adhesive 173 separates from the hem portion 148A or from the hem flap 148B. As a third example, the hem seal could experience both a cohesive failure and an adhesive failure. This peeling in the seal will relieve the stress at the appropriate portion of the hem seal.

Figure 10B:
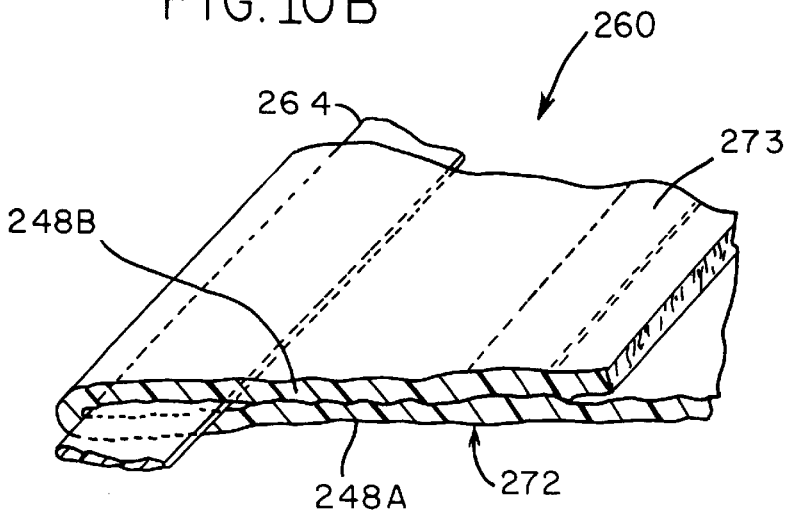
FIG. 10B is a partial cross-sectional view of another embodiment.

In another embodiment, the non-destructive seal may also be achieved by heat sealing. Specifically, referring to FIG. 10B, a hem seal 272 of hem 260 is achieved by using heat sealing 273 which bonds the hem portion 248A and the hem flap 248B. The hem portion 248A and the hem flap 248B may be made of same material noted above for hem portion 148A and the hem flap 148B. In addition, the hem portion 248A and the hem flap 248B enclose the draw tape 264. The heat is regulated such that only a very light bond is maintained between the two layers of film. If too much heat is applied during a heat sealing process, the heat will create a destructive bond. If too little heat is applied during a heat sealing process, the heat will not bond the material properly. Variations in film thickness and surface characteristics must be monitored so that the requisite level of heat is applied consistently.

Figure 10C:
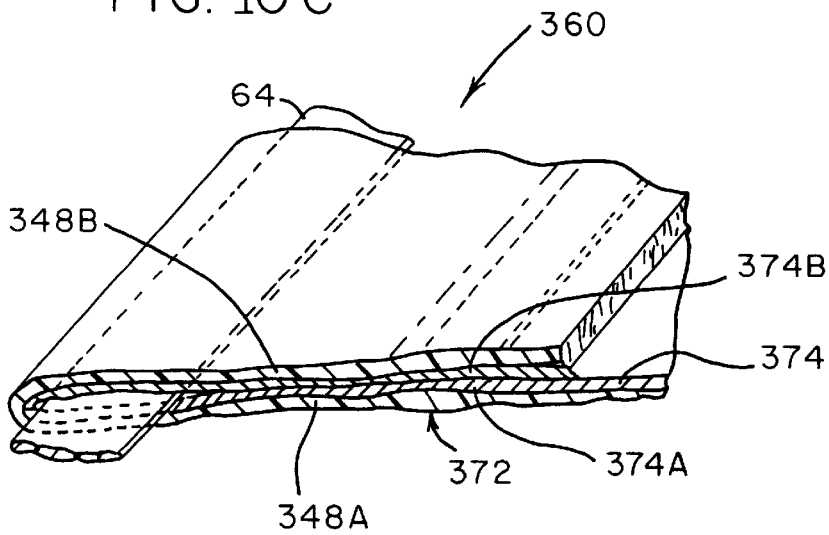
FIG. 10C is a partial cross-sectional view of another embodiment.

In an additional embodiment, heat sealed co-extruded film may be used to achieve a non-destructive hem seal. In this embodiment as shown in FIG. 10C, a thin layer of material 374 is coextruded with the hem portion 348A and the hem flap 348B. The coextruded layer 374 has a lower melting point than the hem portion 348A and the hem flap 348B. For example, the coextruded layer 374 may be a blend of linear low density polyethylene and an ethylene-methacrylic acid copolymer. The ethylene-methacrylic acid copolymer may be supplied by DuPont, Packaging and Industrial Polymers, 1007 Market Street, Wilmington, Del., U.S.A. under the Product Name Nucrel® 0902HC (High Clarity). The resin properties of Nucrel® 0902HC are:

| Resin Property | Typical Value | Test Method |
|---|---|---|
| % Methacrylic acid | 9.0 | DuPont |
| Melt Flow Index, dg/min | 1.5 | ASTM D-1238 condition 109/2.16 |
| Melt Point, ° C. (° F.) | 103 (217) | ASTM D-3418 (DSC) |
| Freeze Point, ° C. (° F.) | 78 (172) | ASTM D-3418 (DSC) |
| Vical softening point, ° C. (° F.) | 81 (178) | ASTM D-1525 |

The hem portion 348A and the hem flap 348B may be made of same material noted above for the hem portion 148A and the hem flap 148B. When the hem 360 is created by folding the hem flap 348B over the hem portion 348A, the coextruded layer 374 is folded over onto itself. Heat is applied that will melt the coextruded layer 374 and form a seal 372 without affecting the hem portion 348A and the hem flap 348B. Thus, the hem encloses the draw tape 364.

Figure 10D:
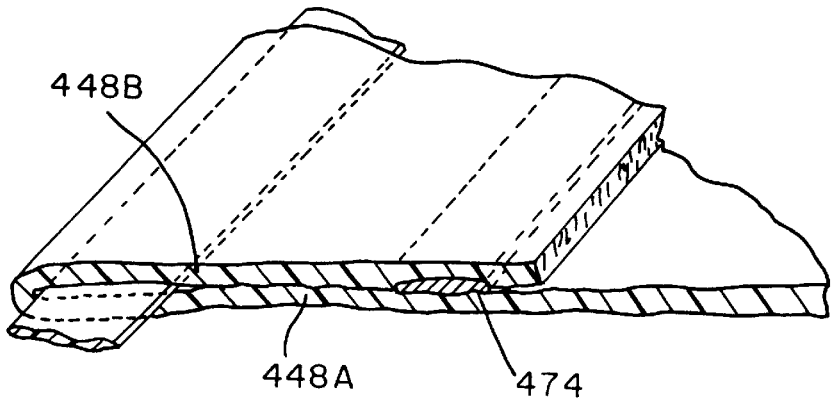
FIG. 10D is a partial cross-sectional view of another embodiment.

Under circumstances where the seal is stressed beyond a predetermined level, the coextruded layer 374, the hem portion 348A and the hem flap 348B will peel away or delaminate from one another. For example, the coextruded portions 374A could separate from the coextruded portion 374B which would be a cohesive failure. As another example, either the coextruded portion 374A could separate from the hem portion 348A or the coextruded portion 374B could separate from the hem flap 348B which would be an adhesive failure. The adhesive failure may occur because the coextruded portion and the film layer are only semi-compatible. As a third example, the hem seal could experience both a cohesive failure and an adhesive failure. This peeling or delamination in the seal will relieve the stress at the appropriate portion of the hem seal. In another embodiment, one of the coextruded portions 374A, 374B could be eliminated so that only one coextruded layer is between the hem portion 348A and the hem flap 348B. Specifically, referring to FIG. 10D, the coextruded portion 474 is located between the hem portion 448A and the hem flap 448B. The coextruded portion 474 could be coextruded onto the hem portion 448A or onto the hem flap 448B. In a further embodiment, the coextruded portion 374A could be made of a different material than the coextruded portion 374B in order to create a differential load on the hem portion and the hem flap.

Figure 10E:
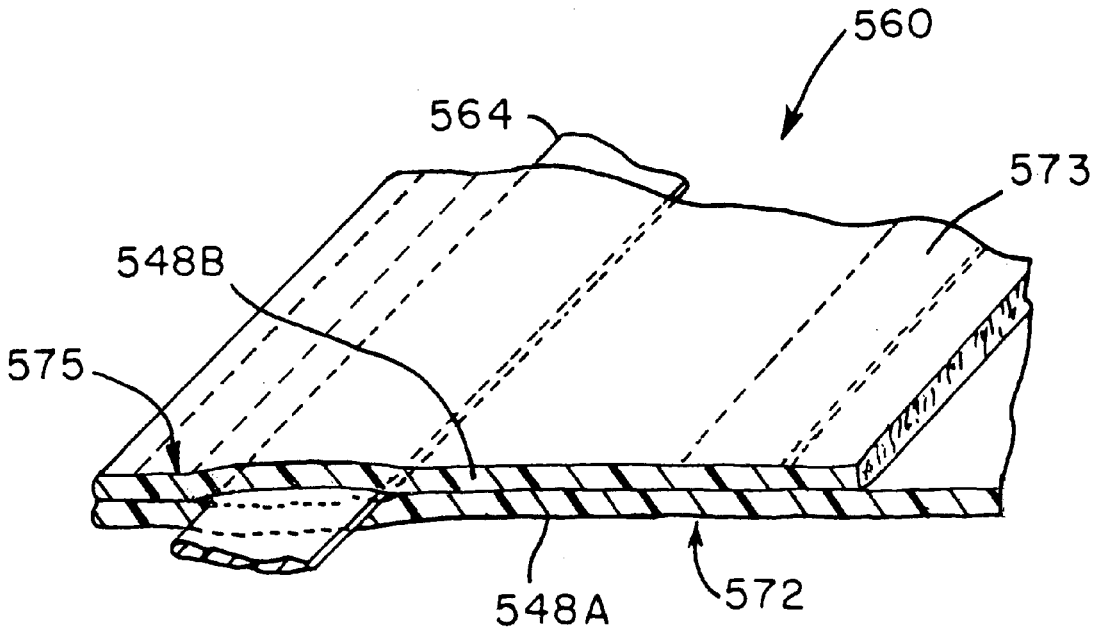
FIG. 10E is a partial cross-sectional view of another embodiment.

In another embodiment, the hem is made by bonding a separate hem flap to the hem portion as opposed to folding the hem flap over the hem portion. Specifically, referring to FIG. 10E, the hem 560 includes a hem flap 548B, a hem portion 548A, a lower hem seal 572 and an upper hem seal 575. The hem flap 548B is a separate layer of film which is bonded to the hem portion 548A at the lower hem seal 572 and the upper hem seal 575. The hem seals 572, 575 run along the width of the bag and secure the draw tape 564 within the hem 560.

The hem seals 572, 575 may be bonded by using an adhesive, a hot seal, or a heat sealed coextruded film which are described herein. In addition, the hem seals 572, 575 may be a combination of the bonding techniques. For example, the upper hem seal 575 may be a heat seal and the lower hem seal 572 may be an adhesive seal.

Furthermore, the hem seals 572, 575 may be non-destructive seals as noted or one of the hem seals may be a non-destructive hem seal and the other hem seal may be a destructive hem seal. For example, the upper hem seal 575 may be a destructive hem seal, such as, a heat seal, and the lower hem seal 572 may be a non-destructive hem seal, such as, an adhesive seal. In another example, the upper hem seal 575 may be a non-destructive hem seal, such as, a heat sealed coextruded film, and the lower hem seal 572 may also be a non-destructive hem seal, such as, an adhesive seal. Furthermore, the non-destructive upper hem seal 575 may open at a higher, lower or substantially equal force as the non-destructive hem seal 572. For example, the non-destructive upper hem seal 575 may require a greater force to open the hem seal 575 than the force required to open the non-destructive lower hem seal 572. As another example, the non-destructive upper hem seal 575 may require a force to open the hem seal 575 which is substantially equal to the force required to open the non-destructive lower hem seal 572.

One process for making a bag, including a continuous length of film, is shown in U.S. Pat. No. 4,624,654 to Boyd, which is incorporated herein by reference. Plastic resin is formed into a continuous length of film or as a tube or as a single film layer or a slit tube which is then folded once and wound into a roll. In order to make the plastic bag, the roll of film is unwound and sent through the bag making process. Draw tape bags with a non-destructive hem seal 72 may be manufactured by utilizing several methods. A non-destructive hem seal using an adhesive may be manufactured by one of the three methods illustrated in FIGS. 11, 12, 13 or 14.

Figure 11:
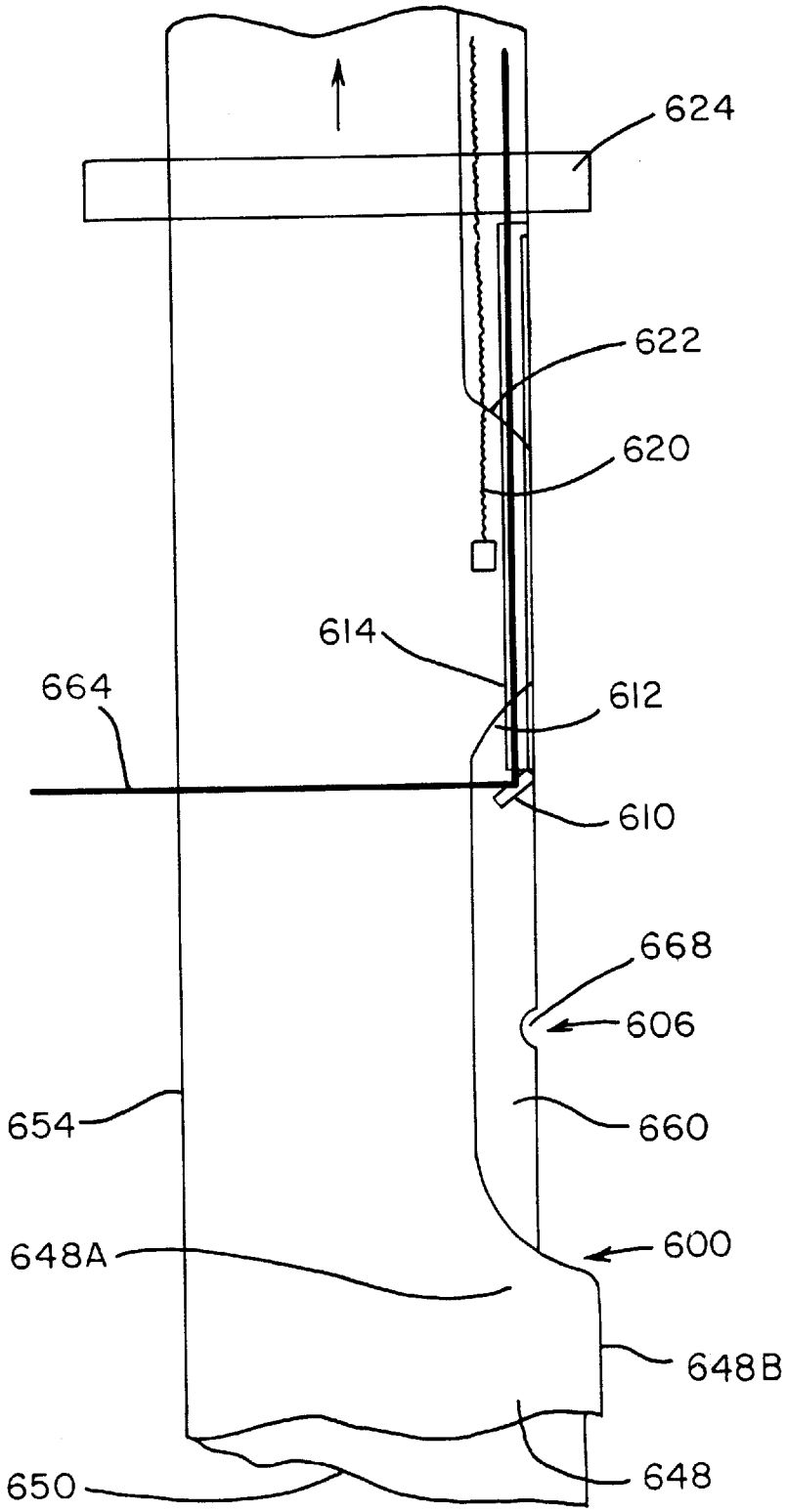
FIG. 11 is a top plan view of one process used to make draw tape bags with peelable hem seals.
Figure 12A:
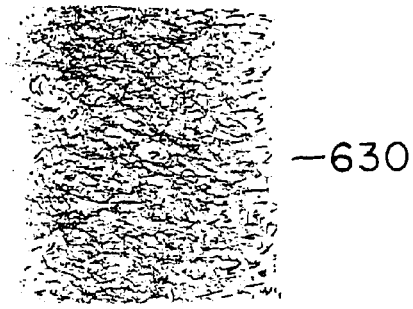
FIG. 12 is a top plan view of the adhesive spray patterns used to bond the hem seal.
Figure 12B:
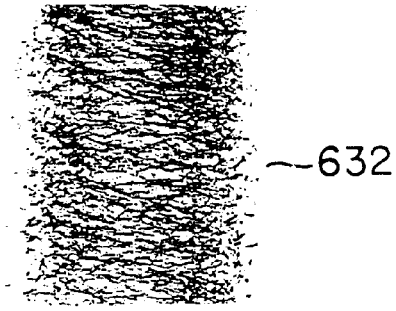
Figure 12C:
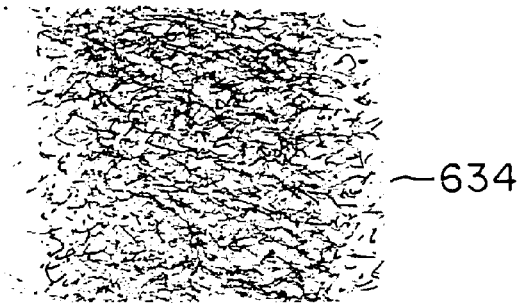
Figure 12D:
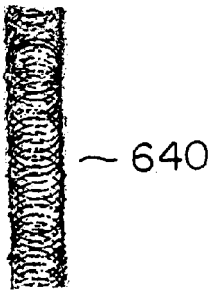
Figure 12E:
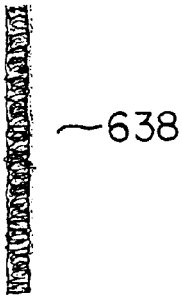
Figure 12F:
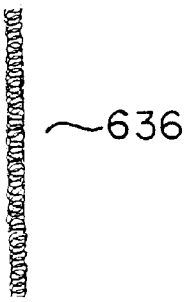

The first method is illustrated in FIG. 11. A continuous length of film is provided which is folded along a longitudinal median line 654 to provide two layers 648, 650. In another embodiment, two separate layers of film could be provided and bonded as opposed to folding the film to obtain the two layers. The method for forming the hem and the corresponding hem seal for the enclosed draw tape may be the same for both layers 648, 650 and could be performed in the same manner at the same time or at different times. Thus, only the method for layer 548 is described in detail. Furthermore, the hem could be folded inwardly or outwardly of the bag opening. In addition, in another embodiment the hem is made by bonding a separate hem flap to the hem portion as described herein versus folding the hem flap over the hem portion.

The method for an outwardly folded hem is described in detail. The film layer 648 advances through the hem folder 600 which folds the hem flap 648B over the hem portion 648A of the film layer 648 to form hem 660. A punch 606 then forms a semi-circular tape access opening 668 at regular intervals along the outer edge of the folded hem 660.

Once the openings 668 have been formed, a tape inserter 610 and a tape guide 614 cooperatively position a continuous length of draw tape 664 within the hem 660. The hem opener 612 then opens the hem 660 enough to allow an adhesive 620 to be applied longitudinally along the outside surface of the film 648. The adhesive 620 may be a hot melt adhesive, such as, a hot melt adhesive sold by Findley Adhesives, Inc. of Wauwatosa, Wis., U.S.A. under Product No. H 1354-01 (described above) which is not tacky until the adhesive is heated and after heating bonds the hem portion and the hem flap when the adhesive cools. The adhesive 620 may also be a pressure sensitive adhesive, such as, a pressure sensitive adhesive sold by Findley Adhesives, Inc. of Wauwatosa, Wis., U.S.A. under Product No. H 2284-01 described above. The pressure sensitive adhesive is tacky, whether the adhesive is hot or cold, and bonds the hem portion and the hem flap when pressure is applied.

The adhesive may be applied in a single bead, multiple beads, a spiral, or a random or other selected pattern. As shown in FIG. 12, a strand pattern may be applied utilizing a light fiber spray pattern 630, a medium fiber spray pattern 632, or a heavy fiber spray pattern 634. In addition, the spiral pattern includes an open spiral spray pattern 636, a dense spiral spray pattern 638, and a wide spiral spray pattern 640. The adhesive may be applied by a hot melt spray gun. Specifically, the spiral patterns and the single bead pattern may be applied by using a spray gun by Nordson Corporation of Duluth, Ga., U.S.A. under Product No. HAM-PAD CF 201-T-FV with a 0.012 inch diameter orifice nozzle. The strand patterns may be applied using a spray gun by Nordson Corporation of Duluth, Ga., U.S.A. under Product No. CC201-C015.00T2 with a 0.002 inch thick brass shim plate and a 0.25 inch wide slot for the adhesive flow.

After the adhesive is applied, the hem closer 622 closes the hem 660. The hem 660, including hem portion 648A and hem flap 648B, then passes through a nip roll 624 which applies heat and/or pressure to activate the adhesive 620. The adhesive 620 bonds the hem portion 648A and hem flap 648B to form a hem seal and a longitudinal channel along the edge of the film layer 648. The film layer, the hem, and the draw tape are then transversely cut and sealed at regular intervals to form the individual bags from the continuous length of film.

Figure 13:
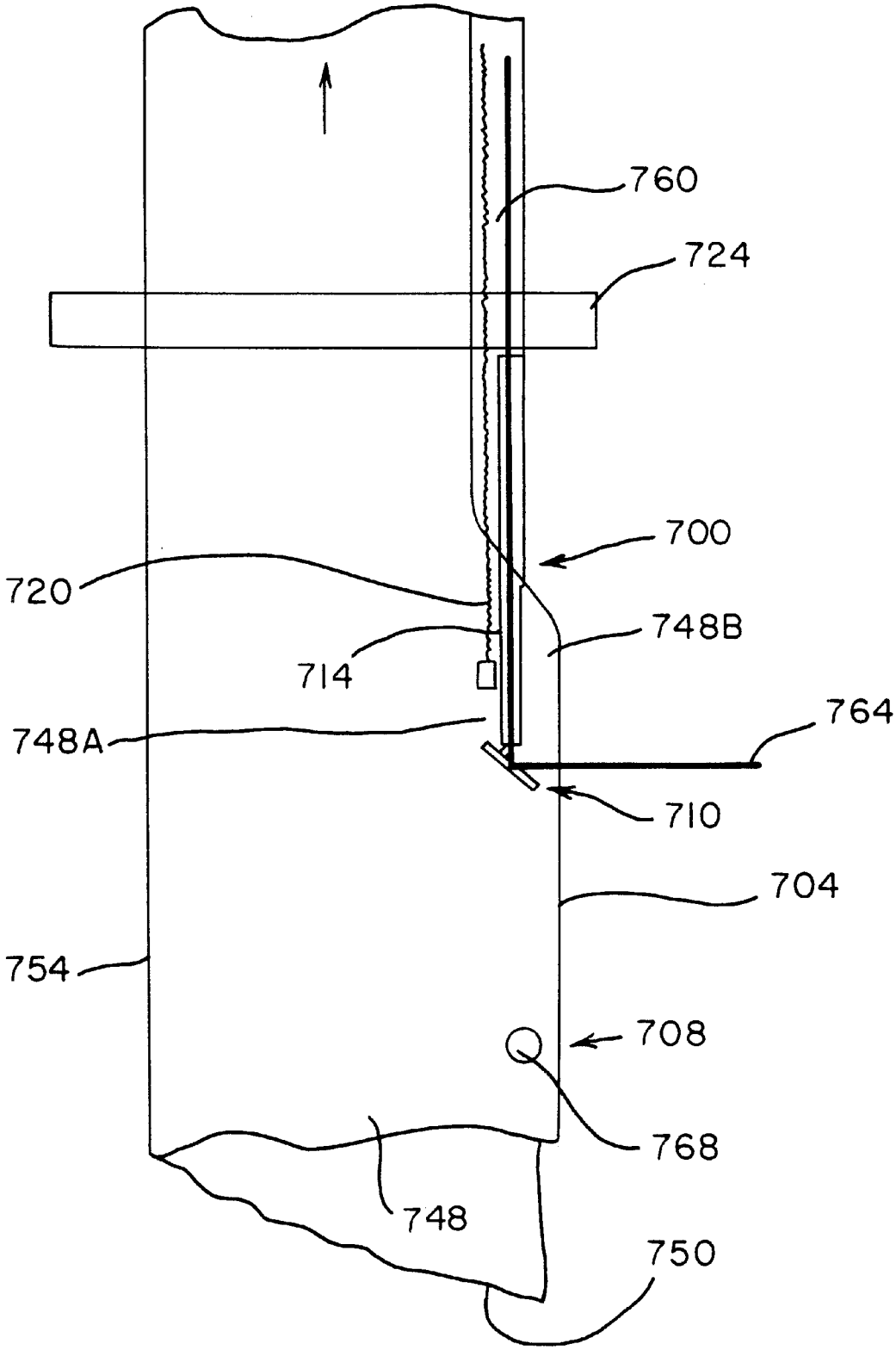
FIG. 13 is a top plan view of another process used to make draw tape bags with peelable hem seals.

The second method is illustrated in FIG. 13. A continuous length of film is provided which is folded along a longitudinal median line 754 to provide two layers 748, 750. In another embodiment, two separate layers of film could be provided and bonded as opposed to folding the film to obtain the two layers. The method for forming the hem and the corresponding hem seal for the enclosed draw tape may be the same for both layers 748, 750 and could be performed in the same manner at the same time or at different times. Thus, only the method for layer 748 is described in detail. Furthermore, the hem could be folded inwardly or outwardly of the bag opening. In addition, in another embodiment the hem is made by bonding a separate hem flap to the hem portion as described herein versus folding the hem flap over the hem portion.

The method for an outwardly folded hem is described in detail. A ballistic punch 708 forms circular tape access openings 768 at regular intervals along the outer edge of the film layer 748. Once the openings 768 have been formed, the tape inserter 710 and tape guide 714 cooperatively position a continuous length of draw tape 764 along the outside edge of the film layer 748.

An adhesive 720 is then applied longitudinally along the outside surface of the film layer 748. The adhesive 720 may be a hot melt adhesive, such as, a hot melt adhesive sold by Findley Adhesives, Inc. of Wauwatosa, Wis., U.S.A. under Product No. H 1354-01 (described above) which is not tacky until the adhesive is heated and after heating bonds the hem portion and the hem flap when the adhesive cools. The adhesive 720 may also be a pressure sensitive adhesive, such as, a pressure sensitive adhesive sold by Findley Adhesives, Inc. of Wauwatosa, Wis., U.S.A. under Product No. H 2284-01 described above. The pressure sensitive adhesive is tacky, whether the adhesive is hot or cold, and bonds the hem portion and the hem flap when pressure is applied.

The adhesive may be applied in a single bead, a multiple bead, or a random or other selected pattern. As shown in FIG. 12, a strand pattern may be applied utilizing a light fiber spray pattern 630, a medium fiber spray pattern 632, or a heavy fiber spray pattern 634. In addition, the spiral pattern includes an open spiral spray pattern 636, a dense spiral spray pattern 638, and a wide spiral spray pattern 640. The adhesive may be applied by a hot melt spray gun. Specifically, the spiral patterns and the single bead pattern may be applied by using a spray gun by Nordson Corporation of Duluth, Ga., U.S.A. under Product No. HAM-PAD CF 201-T-FV with a 0.012 inch diameter orifice nozzle. The strand patterns may be applied using a spray gun by Nordson Corporation of Duluth, Ga., U.S.A. under Product No. CC201-C015.00T2 with a 0.002 inch thick brass shim plate and a 0.25 inch wide slot for the adhesive flow.

Returning to FIG. 13, the film then advances through the hem folder 700 which outwardly folds the hem flap 748B over the hem portion 748A and over the adhesive 720 to form the hem 760. The hem 760 then passes through a nip roll 724 which applies heat and/or pressure to activate the adhesive 720. The adhesive 720 bonds the hem portion 748A to the hem flap 748B to form a hem seal and a longitudinal channel along the edge of the film layer 748. The film layer, the hem and the draw tape are then transversely cut and sealed at regular intervals to form the individual bags from the continuous length of film.

Figure 14:
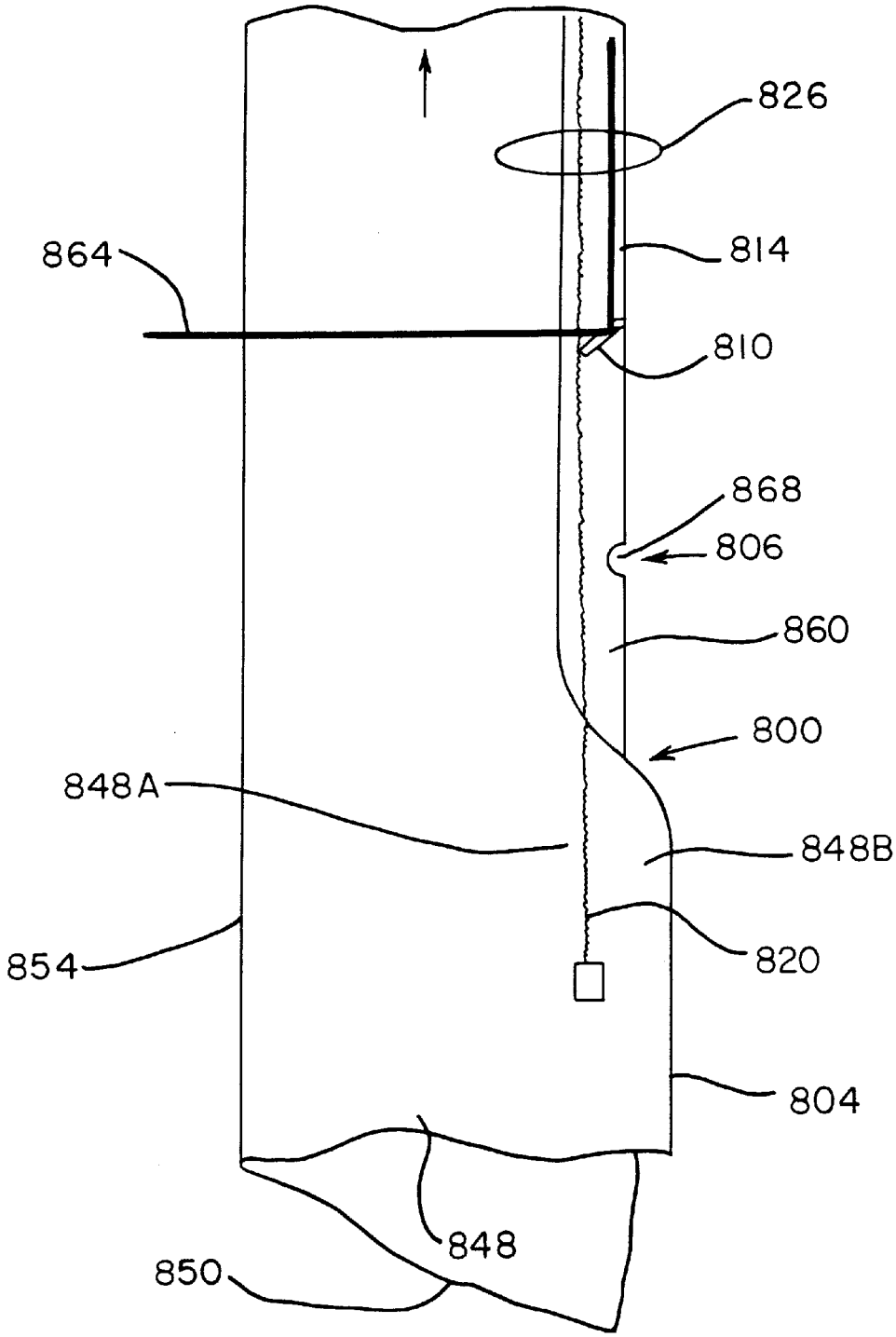
FIG. 14 is a top plan view of another process used to make draw tape bags with peelable hem seals.

The third method is illustrated in FIG. 14. A continuous length of film is provided which is folded along a longitudinal median line 854 to provide two layers 848, 850. In another embodiment, two separate layers of film could be provided and bonded as opposed to folding the film to obtain the two layers. The method for forming the hem and the corresponding hem seal for the enclosed draw tape is the same for both layers 848, 850 and could be performed in the same manner at the same time. Thus, only the method for layer 848 is described in detail. Furthermore, the hem could be folded inwardly or outwardly of the bag opening. In addition, in another embodiment the hem is made by bonding a separate hem flap to the hem portion as described herein versus folding the hem flap over the hem portion.

The method for an outwardly folded hem is described in detail. An adhesive 820 is applied longitudinally along the surface of the film layer 848. The adhesive 820 may be a hot melt adhesive, such as, a hot melt adhesive sold by Findley Adhesives, Inc. of Wauwatosa, Wis., U.S.A. under Product No. H 1354-01 (described above) which is not tacky until the adhesive is heated and after heating bonds the hem portion and the hem flap when the adhesive cools. The adhesive 820 may also be a pressure sensitive adhesive, such as, a pressure sensitive adhesive sold by Findley Adhesives, Inc. of Wauwatosa, Wis., U.S.A. under Product No. H 2284-01 described above. The pressure sensitive adhesive is tacky, whether the adhesive is hot or cold, and bonds the hem portion and the hem flap when pressure is applied.

The adhesive may be applied in a single bead, multiple beads, a spiral, or a random or other selected pattern. As shown in FIG. 12, a strand pattern may be applied utilizing a light fiber spray pattern 630, a medium fiber spray pattern 632, or a heavy fiber spray pattern 634. In addition, the spiral pattern includes an open spiral spray pattern 636, a dense spiral spray pattern 638, and a wide spiral spray pattern 640. The adhesive may be applied by a hot melt spray gun. Specifically, the spiral patterns and the single bead pattern may be applied by using a spray gun by Nordson Corporation of Duluth Ga., U.S.A. under Product No. HAM-PAD CF201-T-FV with a 0.012 inch diameter orifice nozzle. The strand patterns may be applied using a spray gun by Nordson Corporation of Duluth, Ga., U.S.A. under Product No. CC201-C015.00T2 with a 0.002 inch thick brass shim plate and a 0.25 inch wide slot for the adhesive flow.

Returning to FIG. 14, the film layer 848 then advances through the hem folder 800 which folds the hem flap 848B over the hem portion 848A and over the adhesive 820 to form the hem 860. If a pressure sensitive adhesive is used, the hem flap 848B should be held away from the adhesive to prevent the adhesive from bonding the hem flap 848B to the hem portion 848A until the draw tape 864 is inserted. A punch 806 forms semi-circular tape access openings 868 at regular intervals along the outer edges of the folded hem 860.

Once the holes 868 have been formed, a tape inserter 810 and tape guide 814 cooperatively position a continuous length of draw tape 864 within the hem 860. A device for applying heat and/or pressure 826, such as hot air and/or a pressure wheel, is then utilized to activate the adhesive 820. The adhesive 820 bonds the hem portion 848A to the hem flap 848B to form a hem seal and a longitudinal channel along the edge of the film layer 848. The film layer, the hem and the draw tape are then transversely cut and sealed at regular intervals to form the individual bags from the continuous length of film.

The method for manufacturing a non-destructive hem seal utilizing a heat sealed co-extruded film is similar to the process described with respect to FIG. 14, except an adhesive 820 is not utilized. Instead, a co-extruded layer or layers are used. The application of heat and/or pressure 826 activates the co-extruded layer(s) 374A, 374B, 474 (See FIGS. 10C and 10D) and thus creates the hem seal. As noted above, in another embodiment, two separate layers of film may be provided and bonded as opposed to folding the film to obtain the two layers. Furthermore, in another embodiment, the hem may be made by bonding a separate hem flap to the hem portion as described herein versus folding the hem flap over the hem portion.

The method for manufacturing a non-destructive hem seal utilizing heat sealing is similar to the process described with respect to FIG. 14, except an adhesive 820 is not utilized. In addition, the device 826 for applying heat and/or pressure is hot air which is blown onto the hem and is followed by a warm wheel which engages the hem and creates a heat seal to bond the hem portion 848A and the hem flap 848B. The amount of heat is controlled to form a non-destructive seal. If the amount of heat is too small, then a seal will not be created or the seal will be too weak. If the seal is not created or too weak, the draw tape will fall into the bag. On the other hand, if the amount of heat is too large, then the heat will form a destructive bond, thin the layers and/or burn a hole through the layers. As noted above, in another embodiment, two separate layers of film may be provided and bonded as opposed to folding the film to obtain the two layers. Furthermore, in another embodiment, the hem may be made by bonding a separate hem flap to the hem portion as described herein versus folding the hem flap over the hem portion.

While the invention is described in connection with these embodiments, it will be understood that it is not intended to limit the invention to these embodiments. On the contrary, it is intended to cover all alternatives, modifications and equivalents as may be included within the spirit and scope of the invention as defined by the appended claims.

What is claimed is:

1. A draw tape bag comprising a container portion and an opening portion, said opening portion including a hem, said hem includes a draw tape for closing said opening, said hem includes a hem seal wherein a portion of said hem seal will open when a force is applied to said portion which exceeds a predetermined value, said value is less than the force required to tear the bag.

2. The invention as in claim 1 wherein said hem includes a hem portion and a hem flap, and said hem seal bonds said hem portion to said hem flap.

3. The invention as in claim 2 wherein said container portion includes two layers of plastic film enclosed on three sides.

4. The invention as in claim 1 wherein said hem seal includes an adhesive.

5. The invention as in claim 4 wherein said adhesive is a pressure sensitive adhesive.

6. The invention as in claim 4 wherein said adhesive is a hot melt adhesive.

7. The invention as in claim 2 wherein said hem seal includes an adhesive.

8. The invention as in claim 7 wherein said adhesive is a pressure sensitive adhesive.

9. The invention as in claim 7 wherein said adhesive is a hot melt adhesive.

10. The invention as in claim 1 wherein said hem includes a coextruded film and said hem seal is formed by melting said coextruded film.

11. The invention as in claim 10 wherein said coextruded film includes ethylene-methacrylic acid copolymer.

12. The invention as in claim 2 wherein said hem portion includes a coextruded film, said hem seal is formed by melting said coextruded film.

13. The invention as in claim 2 wherein said hem flap includes a coextruded film, said hem seal is formed by melting said coextruded film.

14. The invention as in claim 2 wherein said hem portion includes a first coextruded film and said hem flap includes a second coextruded film, said hem seal is formed by melting together said first coextruded film and said second coextruded film.

15. The invention as in claim 14 wherein said first coextruded film is made of the same material as said second coextruded film.

16. The invention as in claim 14 wherein said first coextruded film is made of a different material than said second coextruded film.

17. The invention as in claim 1 wherein said hem seal is formed by a heat seal.

18. The invention as in claim 2 wherein said hem seal is formed by a heat seal.

19. The invention as in claim 1 wherein the minimum energy necessary to open said hem seal is equal to or greater than 0.02 in-lbs.

20. The invention as in claim 1 wherein the energy necessary to open said hem seal is in the range from 0.02 in-lbs. to 99.9% of the energy necessary to tear said bag.

21. The invention as in claim 1 wherein the energy necessary to open said hem seal is in the range from 10% to 90% of the energy necessary to tear said bag.

22. The invention as in claim 1 wherein the energy necessary to open said hem seal is in the range from 20% to 70% of the energy necessary to tear said bag.

23. The invention as in claim 1 wherein the energy necessary to open said hem seal is in the range from 20% to 50% of the energy necessary to tear said bag.

24. The invention as in claim 1 wherein said hem seal is a lower hem seal.

25. The invention as in claim 1 wherein said hem seal is an upper hem seal.

26. The invention as in claim 1 wherein said hem seal is a lower hem seal and said hem also includes an upper hem seal.

27. A method of forming bags comprising the steps of:

providing two material layers each with a longitudinal free edge and an opposite edge;

providing a hem flap along the two longitudinal free edges to provide a pair of longitudinal hems;

providing a separate, continuous material strip for each hem;

longitudinally joining together the double layer thicknesses of each hem to form a hem seal and a channel along the longitudinal free edge of each layer containing one of the continuous strips; and transversely severing the pliable bag material and strips at regular intervals along the length of the pliable bag material to separate individual bag lengths from the continuous length of pliable bag material wherein a portion of said hem seal will open when a force is applied to said portion which exceeds a predetermined value, said value is less than the force required to tear the bag.

28. The invention as in claim 27 wherein the step of providing the two material layers comprises providing one continuous length of pliable bag material folded once longitudinally and having a longitudinal fold edge and two material layers each with a longitudinal free edge opposite the fold edge.

29. The invention as in claim 27 wherein the step of providing the two material layers comprises providing two separate continuous lengths of pliable bag material and further comprising the step of joining the two opposite edges.

30. The invention as in claim 27 wherein the step of providing the hem flap comprises folding the longitudinal free edge to provide the longitudinal hem.

31. The invention as in claim 27 wherein the step of providing the hem flap comprises providing a separate continuous length of hem flap material and further comprising the step of providing a second hem seal to form said channel.

32. The invention as in claim 27 wherein the joining step includes using an adhesive.

33. The invention as in claim 32 wherein the adhesive is a pressure sensitive adhesive.

34. The invention as in claim 32 wherein the adhesive is a hot melt adhesive.

35. The invention as in claim 32 wherein the adhesive is applied to the bag material.

36. The invention as in claim 32 wherein the adhesive is applied before the providing a hem flap step.

37. The invention as in claim 32 wherein the adhesive is applied after the providing a hem flap step.

38. The invention as in claim 32 wherein the adhesive is applied before the step of providing the strip.

39. The invention as in claim 32 wherein the adhesive is applied after the step of providing the strip.

40. The invention as in claim 32 wherein the providing a hem flap step is performed before the step of providing the strip and adhesive is applied after the step of providing the strip.

41. The invention as in claim 40 further comprising the step of providing an opening in each hem after the providing a hem flap step.

42. The invention as in claim 32 wherein the step of providing the strip is performed before the adhesive is applied and the providing a hem flap step is performed after the adhesive is applied.

43. The invention as in claim 42 further comprising the step of providing an opening in each hem before the step of providing the strip.

44. The invention as in claim 32 wherein the adhesive is applied before the providing a hem flap step and the step of providing the strip is performed after the providing a hem flap step.

45. The invention as in claim 44 further comprising the step of providing an opening in each hem after the providing a hem flap step.

46. The invention as in claim 27 wherein the step of providing a strip is performed after the providing a hem flap step.

47. The invention as in claim 27 wherein the step of providing a strip is performed before the providing a hem flap step.

48. The invention as in claim 27 further comprising the step of providing an opening in each hem to expose the strip.

49. The invention as in claim 27 wherein the step of providing an opening is performed after the providing a hem flap step.

50. The invention as in claim 27 wherein the step of providing an opening is perform ed before the providing a hem flap step.

51. The invention as in claim 27 wherein the hem includes a coextruded film and the hem seal is formed by melting the coextruded film.

52. The invention as in claim 51 further comprising the step of providing an opening in each hem.

53. The invention as in claim 52 wherein the providing a hem flap step is performed before the step of providing the opening and the step of providing the strip is performed after the step of providing the opening.

54. The invention as in claim 27 wherein the hem seal is formed by a heat seal.

55. The invention as in claim 54 further comprising the step of providing an opening in each hem.

56. The invention as in claim 27 wherein the minimum energy to open the hem seal is equal to or greater than 0.02 in-lbs.

57. A method for making a draw tape bag comprising the steps of:

providing a container portion and an opening portion, providing said opening portion with a hem, providing said hem with a draw tape for closing said opening, providing said hem with a hem seal wherein a portion of said hem seal will open when a force is applied to said portion which exceeds a predetermined value, said value is less than the force required to tear the bag.

58. The invention as in claim 57 further providing said hem with a hem portion and a hem flap, and said hem seal bonds said hem portion to said hem flap.

59. The invention as in claim 58 further providing said container portion with two layers of plastic film enclosed on three sides.

60. The invention as in claim 57 further providing said hem seal with an adhesive.

61. The invention as in claim 60 wherein said adhesive is a pressure sensitive adhesive.

62. The invention as in claim 60 wherein said adhesive is a hot melt adhesive.

63. The invention as in claim 58 further providing said hem seal with an adhesive.

64. The invention as in claim 63 wherein said adhesive is a pressure sensitive adhesive.

65. The invention as in claim 63 wherein said adhesive is a hot melt adhesive.

66. The invention as in claim 57 further providing said hem with a coextruded film and said hem seal is formed by melting said coextruded film.

67. The invention as in claim 66 wherein said coextruded film includes ethylene-methacrylic acid copolymer.

68. The invention as in claim 58 further providing said hem portion with a coextruded film, said hem seal is formed by melting said coextruded film.

69. The invention as in claim 58 further providing said hem flap with a coextruded film, said hem seal is formed by melting said coextruded film.

70. The invention as in claim 58 further providing said hem portion with a first coextruded film and providing said hem flap with a second coextruded film, said hem seal is formed by melting together said first coextruded film and said second coextruded film.

71. The invention as in claim 70 wherein said first coextruded film is made of the same material as said second coextruded film.

72. The invention as in claim 70 wherein said first coextruded film is made of a different material than said second coextruded film.

73. The invention as in claim 57 wherein said hem seal is a heat seal.

74. The invention as in claim 58 wherein said hem seal is a heat seal.

75. The invention as in claim 57 wherein the minimum energy necessary to open said hem seal is equal to or greater than 0.02 in-lbs.

* * * * *